US005381844A

United States Patent [19]

Struben

[11] Patent Number: 5,381,844

[45] Date of Patent: Jan. 17, 1995

[54] PORTABLE TWO-WAY ALUMINUM AWNING FOR RECREATIONAL VEHICLES

[76] Inventor: Francis L. Struben, 3854 Jarrettsville Pike, Jarrettsville, Md. 21084

[21] Appl. No.: 40,612

[22] Filed: Mar. 31, 1993

[51] Int. Cl.[6] ..... E04F 10/00

[52] U.S. Cl. ..... 160/46; 52/79.5; 52/91.1; 52/592.1; 135/88.1; 160/61

[58] Field of Search ..... 160/46, 47, 59, 61, 160/83.1, 44, 45; 135/89, 88; 52/592.1, 589.1, 592.4, 93.1, 91.1, 66, 79.5; 49/384

[56] References Cited

U.S. PATENT DOCUMENTS

| | | | |
|---|---|---|---|
| 827,483 | 7/1906 | Voorhees | 160/61 X |
| 2,593,221 | 4/1952 | Thompson et al. | 160/61 |
| 2,706,132 | 4/1955 | Chaffin | 135/89 X |
| 2,808,065 | 10/1957 | Ellis | 135/89 X |
| 2,811,935 | 11/1957 | Jones | 135/89 X |
| 2,848,765 | 8/1958 | Showalter | 52/66 X |
| 2,865,589 | 12/1958 | D'Azzo | 160/82 X |
| 2,896,706 | 7/1959 | Schantz | 160/62 |
| 2,909,220 | 10/1959 | Zimmerman | 135/89 X |
| 3,100,012 | 8/1963 | Dunn | 160/46 X |
| 3,286,404 | 11/1966 | Harrison | 52/91.1 X |
| 3,327,724 | 6/1967 | Nielsen | 135/89 X |
| 3,367,076 | 2/1968 | O'Brien | 52/592.4 X |
| 3,800,484 | 4/1974 | Marshall | 160/46 X |
| 3,998,023 | 12/1976 | Anderson | 52/592.1 |
| 4,117,876 | 10/1978 | Bennett | 135/89 X |

*Primary Examiner*—David M. Purol

[57] ABSTRACT

The present invention is a portable two-way awning for use with recreational type trailer vehicles. The awning is comprised of a number of roof panels made with two sheets of aluminum surrounding a polystyrene core. A hanger mechanism is bonded to each of the panels, and suspends them on an adapter rail that slidingly engages with a standard awning attachment rail. The roof panels mate together via a number of interlocking members disposed on their mating sides. The outer periphery of the roof assembly is surrounded with a number of extrusion members. Once the roof assembly is pivoted to a nearly horizontal position, it is supported at its front end by a number of adjustable height poles, two of which swing freely into a vertical position when the roof is initially erected. The awning requires no tools or caulking to set-up, and takes less than thirty minutes to either erect or dismantle. The awning is relatively light in weight, yet strong enough to withstand the harshest of weather conditions.

21 Claims, 10 Drawing Sheets

PORTABLE TWO-WAY ALUMINUM AWNING FOR RECREATIONAL VEHICLES

BACKGROUND OF THE INVENTION

This invention relates to new improvements in awnings used in conjunction with recreational vehicles such as the travel trailer, fifth wheel trailer, park model, certain type motor homes and other camping trailers.

Awnings currently available for use on recreational vehicles are canvas or fabric type roll-up awnings. While these awnings do have certain advantages—shading from the sun, rolling up and down in certain fashion and being stored in a minimum of space, they only function well in moderate weather.

The flexible roof, inherent in the design of roll-up awnings, renders them ineffective and dangerous in a sudden wind or rain storm. They can fill up with rain water, collapse, whip and tear apart. Also, when this type of awning is rolled up on the side of a trailer that is travelling on the highway, it can unroll, come loose and cause an accident.

Due to the nature of canvas or fabric, the life span of roll-up awnings is limited as they deteriorate and need considerable maintenance. It is not advisable to leave a roll-up awning opened and go away for a few days since there is always the worry that a sudden change in the weather will destroy it. The purpose of any awning is to provide shelter from inclement weather. Since the canvas awning fails miserably at this, a new type of awning for use on recreational vehicles has been developed.

SUMMARY OF THE INVENTION

This present invention is a portable "two-way" aluminum awning designed for recreational vehicles (trailers). To erect a different type awning, it is necessary to have a different type awning rail. For the method of assembly of the "two-way" aluminum awning, it is necessary for an adapter rail to slide into the standard awning rail that is permanently attached to all trailers and is used by roll-up awnings. Sliding the adapter rail into the trailer rail, requires no additional holes or screws.

A combination of sheet aluminum, polystyrene and aluminum extrusions form rigid panels that slide vertically (along side of trailer) into the adapter rail. When all panels are connected together, two aluminum adjusting poles are attached—one to each end of awning. Two people can easily lift awning to a near horizontal position, ready for additional poles.

All poles are then attached and are secured to the ground with adjustable straps on to spiral ground anchors. The trim and decorative valance are added to complete erection of awning. Other than connecting adjustable poles to concrete, two (2) people can easily erect or dismantle an average size awning (8'×16') without tools or caulking in less than 30 minutes.

By just removing poles, it may also be folded down in just five (5) minutes. Each panel will support 300 pounds. It is very light weight (15 pounds each). Since it is designed to be assembled or disassembled by two (2) people, one person, after installing it several times, can also erect or dismantle it in less than 30 minutes. An optional mechanical device or preferably a gas spring can be used to lift or lower an awning, thus requiring a minimal physical effort.

BEST KNOWN PRIOR ART

The best known prior U.S. art is as follows:

U.S. Pat. Nos. 827,483; 2,706,132; 2,865,589; 2,896,706; 2,909,220; 4,117,876;

The prior art includes numerous inventions and improvements in the art of awning assemblies. The Schantz U.S. Pat. No. 2,896,706 describes a canopy assembly for vending stand trailers comprising a roof and a pair of spaced supporting side members. The U.S. Pat. No. 2,865,589 issued to D'Azzo teaches a new support for lateral and angular adjustment of awning rafters resting thereon. The support consists of a molding having a fiat section, a curved ledge, and an adapter clamp connecting a rafter support to the curved ledge and molding assembly.

An improved type of roll-up awning is the subject of the Bennett U.S. Pat. No. 4,117,876. The Bennett invention includes a retractable awning disposed on a roller and supported by a pair of telescoping, collapsible arm assemblies. Telescoping rafter arms extend from the upper portion of the trailer wall to movable slides along the arm assemblies. The simplified Bennett awning allows for quick and easy extension/retraction of the roll-up roof, and is considered to be an improvement over previous roll-up awning assemblies which incorporated free ends.

Though the Bennett invention did provide an awning assembly for trailer type vehicles that was easy to set-up, it still suffered from the drawbacks of the roll-up roof design. That is, the fact that roll-up roofs are not strong enough to sustain either extremely high wind speeds or anything other than a minimal snow fall.

There are many awnings documented in the art that incorporate rigid roof designs. One such awning, having an adjustable roof portion with flanges that are pivotally connected to a pair of end brackets, is the subject of the Voorhes U.S. Pat. No. 827,483. Like the present invention, the Voorhes awning consists of two end sections and one or more intermediate sections. The Zimmerman U.S. Pat. No. 2,909,220 discloses a house trailer awning having rigid inner and outer sections. When unfolded, the inner and outer sections form the awning roof. Perhaps the most novel feature of the Zimmerman patent is the way in which the sections are folded to a stored position upon the trailer roof. This is accomplished by first pivoting the outer member onto the inner member by means of a first hinge, and then by pivoting both members onto the trailer roof by means of a second hinge.

Though the Zimmerman invention does teach a unique method of storing a rigid awning assembly, the actual unfolding of the assembly appears difficult since the awning is in fact on top of the trailer. Also, the hinge assembly connecting the two sections to the trailer is not standard attachment means on trailers, but would need to be added specifically for the Zimmerman awning assembly.

Another awning assembly designed for recreational type of trailer vehicles is described in the Chaffin U.S. Pat. No. 2,706,132. The Chaffin invention is a retractable awning comprising, in part, a housing disposed in the side of the trailer itself. The rigid awning roof member, consisting of one or more panels connected together, is pivotally connected to a carriage supported on rollers running on tracks within the housing. When the awning roof member is fully retracted, the rollers become engaged in wells along the tracks, and the awning roof member is secured in place by means of a locking member.

Though the Chaffin awning roof invention appears easy to set-up, the overall design appears extremely complicated. Those trailers that are either built or tailored to receive the Chaffin awning would more than likely experience a reduction in inner space, since the awning roof and housing are stored in the upper interior of the trailer. Furthermore, since the trailer would need to be either custom built or modified to accept the housing, the Chaffin awning assembly isn't readily adaptable to most recreational trailer vehicles.

As is the case with nearly all rigid awning roof assemblies for trailers, the Zimmerman and Chaffin inventions suffer from the drawback that they are not readily adaptable to most recreational vehicle trailers. These types of awnings must either be built into the original design of the trailer, or added thereto.

The present invention is a rigid type of fold-down, modular awning for use with nearly all trailer vehicles. The awning is relatively light in weight, easy to set-up and disassemble, and unique in design. The novel construction of the awning, allowing for an effective shelter against harsh elements, renders it an improvement over previous assemblies which suffer from the aforementioned problems.

OBJECTS OF THE INVENTION

It is an object of this invention to provide a portable two-way awning for use with a recreational type of trailer vehicle.

Another object of this invention is to provide a unique portable two-way awning with a modular design requiring no tools or caulking to set-up or disassemble.

To provide a novel trailer awning assembly that consists of a number of aluminum and polystyrene panels, pivotally connected to an adapter rail that mates with a standard trailer awning attachment rail, is another object of this invention.

And to provide a portable two-way awning assembly that is relatively light in weight, easy to assemble, and dependable in operational use, is yet another object of this invention.

BRIEF DESCRIPTION OF THE DRAWINGS

These and other attendant advantages of this invention will become more obvious and apparent from the following detailed specification and accompanying drawings in which.

DESCRIPTION OF THE PREFERRED EMBODIMENTS

Figure 1:
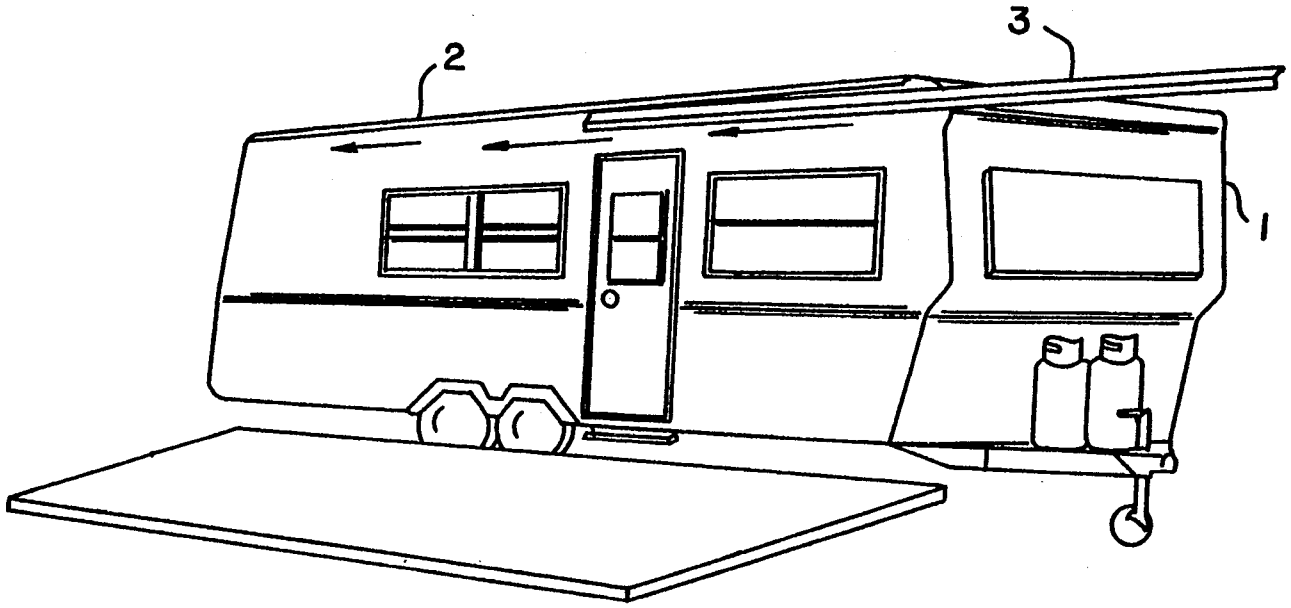
FIG. 1 is a perspective view of a typical trailer having an adapter rail slidingly fed into a standard awning attachment rail connected thereon, the adapter rail incorporating novel features of this invention.

Referring now to FIGS. 1 to 9 of the drawings, there is shown the preferred embodiment of a fold-down awning assembly for use with a recreational type of trailer vehicle 1. The awning assembly primarily consists of an adapter rail 3, a number of roof panels 4, 5, 6, two side extrusion members 7, two front extrusion member 13, and a number of adjustable height pole support member 18.

Figure 2:
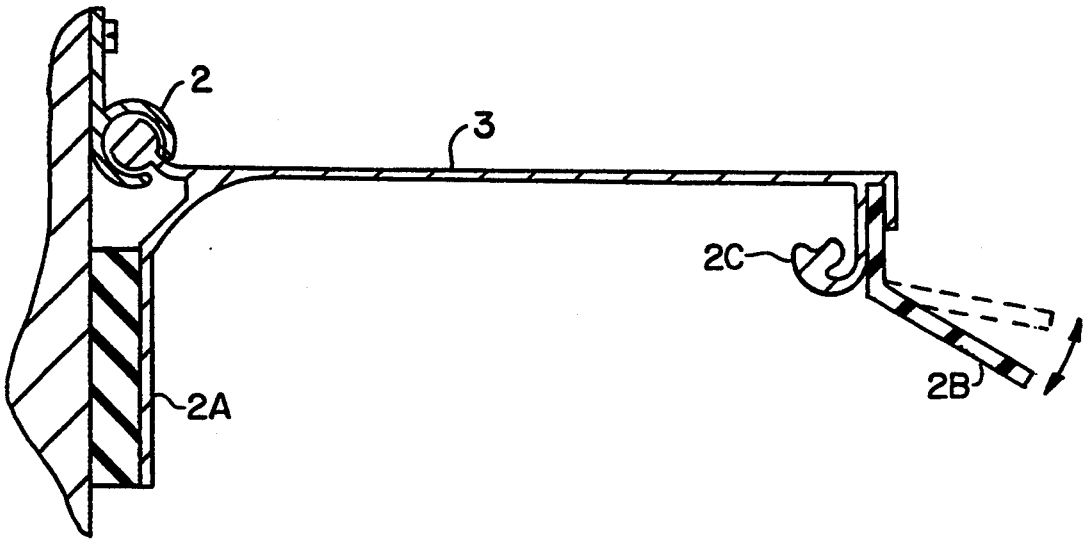
FIG. 2 is a side section view of the trailer side, attachment rail, and adapter rail of FIG. 1.

As seen in FIG. 1, the first step in erecting the awning assembly is to slide the adapter rail 3 into the standard awning attachment rail 2 mounted to the upper side of trailer vehicle 1. FIG. 2 depicts the sliding connection of the adapter rail 3 into the awning attachment rail 2 in great detail. The adapter rail 3 is made from aluminum, and has a rubber stand-off 2A bonded to a flange along its inner end. The rubber stand-off 2A rests against the side of the trailer 1 as the adapter rail 3 sits in position. At the opposite end, the adapter rail 3 has a vinyl flashing 2B inserted into a slot and an upwardly turned ledge 2C having an arcuate opening defined therein. The flashing 2B, the ledge 2C, and the stand-off 2A all extend along the entire length of the adapter rail 3.

Figure 3A:
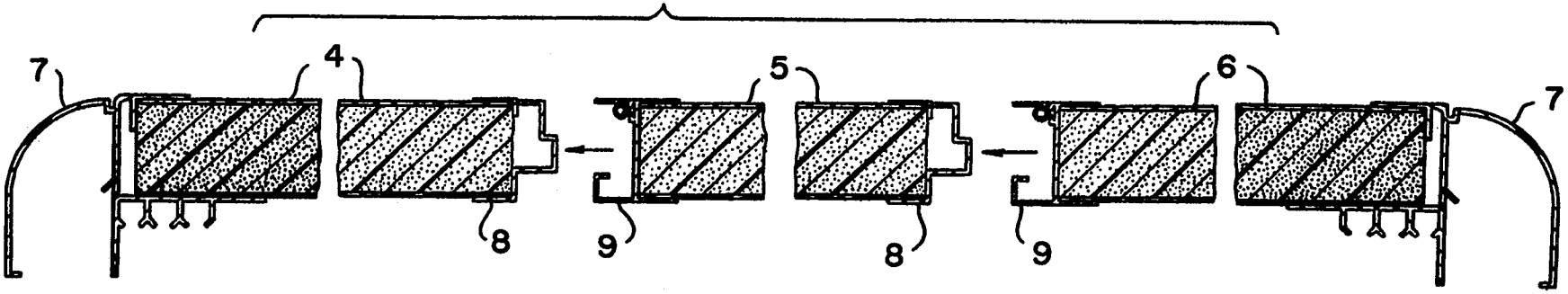
FIG. 3A is front section view, exploded in nature and cut three times, of a series of mating roof panels having an extrusion attached to the left and right sides of the extreme panel members, incorporating other novel features of this invention.

The roof panels 4, 5, 6 to be suspended on the adapter rail 3 are shown in FIG. 3A. For simplicity, there are two end panels 4, 6 and only one intermediate panel 5 shown. Yet, there may in fact be more than one intermediate panel 5 in the final assembly. The exact number of intermediate panels 5 depends on the relative size of the awning. Wherein a larger awning would necessitate more intermediate panels 5, a smaller awning would require fewer. Regardless of the number of intermediate panels 5, a complete awning assembly will always have a left end panel 4 and a right end panel 6.

All panels are constructed with two sheets of aluminum bonded to a polystyrene core. The left end panel 4 and the right end panel 6 have a side extrusion member 7 bonded to their left and right sides, respectively. The side extrusion members 7 have adjustable trim 22 attached for making sealed connections at walls and corners (see FIG. 8A and FIG. 8B). The three adjacent slots 24, 25, 26 on the lower flat surfaces of the side extrusion members 7 are for holding a canvas valence 21 (see FIG. 8A and FIG. 8B), a screen enclosure weather panel (not shown), and a number of individual screen panels (not shown). The left end panel 4 has a male interlocking member 8 bonded to its right side. The male interlocking member 8 mates with a female interlocking member 9 bonded to the left side of the adjacent intermediate panel 5. The intermediate panel 5 also has a male interlocking member 8 bonded to its right side. This male interlocking member 8 mates with a female interlocking member 9 bonded to the left side of the adjacent right end panel 5. In another arrangement, a number of intermediate panels 5 may mate with one another before mating with the final right end panel 6.

Figure 3B:
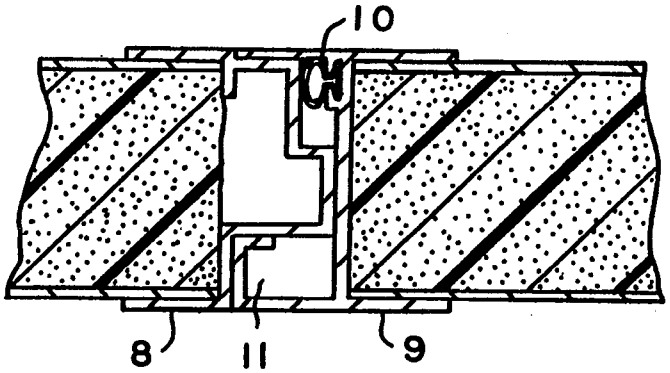
FIG. 3 is a front section view, much enlarged, of the connection of two of the mating roof panels of FIG. 3A.

A detailed and enlarged view of the connection between a male interlocking member 8 and a female interlocking member 9 is depicted in FIG. 3B. As seen in FIG. 3B, the female interlocking member 9 has a vinyl bubble seal 10 attached to its upper portion. Any water that passes the bubble seal 10 is caught in a water trough 11 defined in the lower portion of the female member 9, and gravity discharged out of the front of the roof assembly. In this respect, the roof panels 4, 5, 6 may be connected together without caulking or tools so as to prevent water leakage through the roof assembly.

Figure 4A:
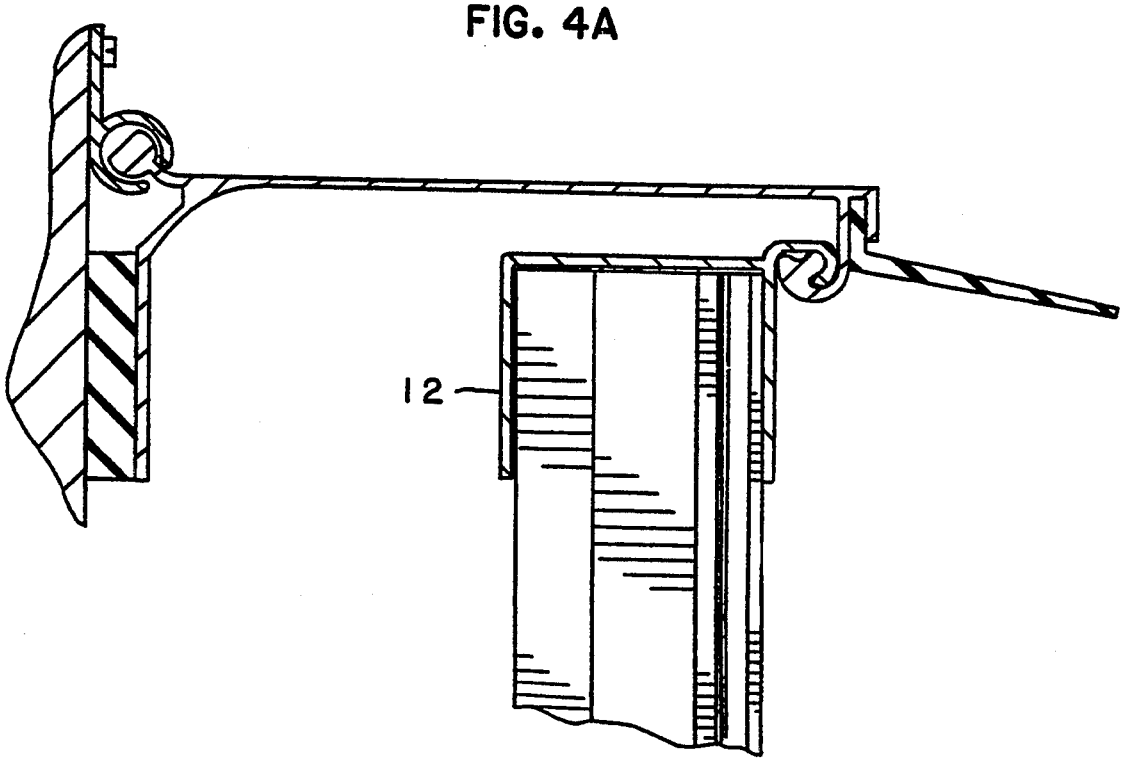
FIG. 4A is a side section view of one of the roof panels of FIG. 3A having been slidingly fed into the adapter rail of FIG. 2, illustrating how the roof panels hang vertically on the adapter rail ledge.

All panels 4, 5, 6 have a hanger member 12 bonded to their rear sides. As seen in FIG. 4A, each hanger member 12 has a flange with a flat portion, and then a curved portion, extending therefrom. The curved portion of the flange is shaped in such a way as to mate with the upwardly turned ledge 2c of the adapter rail 3. In order to suspend the roof panels 4, 5, 6 on the adapter rail 3, they must be individually slid onto the turned ledge 2C on the adapter rail 3. The first panel to be attached to the adapter rail is invariably the left end panel 4. Then, all intermediate panels 5 may be attached. Finally, the right end panel 6 is attached. Throughout this process, the panels 4, 5, 6 are locked together by means of the male and female interlocking members 8, 9 as they are slid onto the upwardly turned ledge 2C of the adapter rail 3.

Still referring to FIG. 4A, consider all panels 4, 5, 6 to have been slidingly connected onto the adapter rail via their respective hanger members 12, and also to have been locked together. Without further manipulation, the panels 4, 5, 6 hang vertically along the side of the trailer 1. The straight portion of the flange extending from each of the hanger members 12 rests flush against the top surface of the upwardly turned ledge 2C of the adapter rail 3. The inner and outer surfaces of the curved portion of the flange extending from each of the hanger members 12 fit snugly into the curved opening defined in the upwardly turned ledge 2C of the adapter rail 3. In this position, the roof panels 4, 5, 6 are restrained from any movement except for an outwardly pivoting motion. The panels 4, 5, 6 cannot pivot inwardly since the tip of the curved portion of the flange extending from each of the hanger members 12 is positioned against the end of the inner arc shaped opening in the upwardly turned ledge 2C of the adapter rail 3. The panels 4, 5, 6 cannot move upward since the inner surface of the curved portion of the flange extending from each of the hanger members 12 is positioned underneath a flap protruding inward and defined by the inner end of the upwardly turned ledge 2C of the adapter rail 3.

This latter design feature is significant since the roof panel assembly may be completely restrained from any movement simply by restricting pivoting in the outward direction. In this sense, the roof panels 4, 5, 6 may be safely stored along side of the trailer 1 without danger of dismantling, so long as the interlocked panels 4, 5, 6 are restrained from pivoting in an outward motion.

Figure 4B:
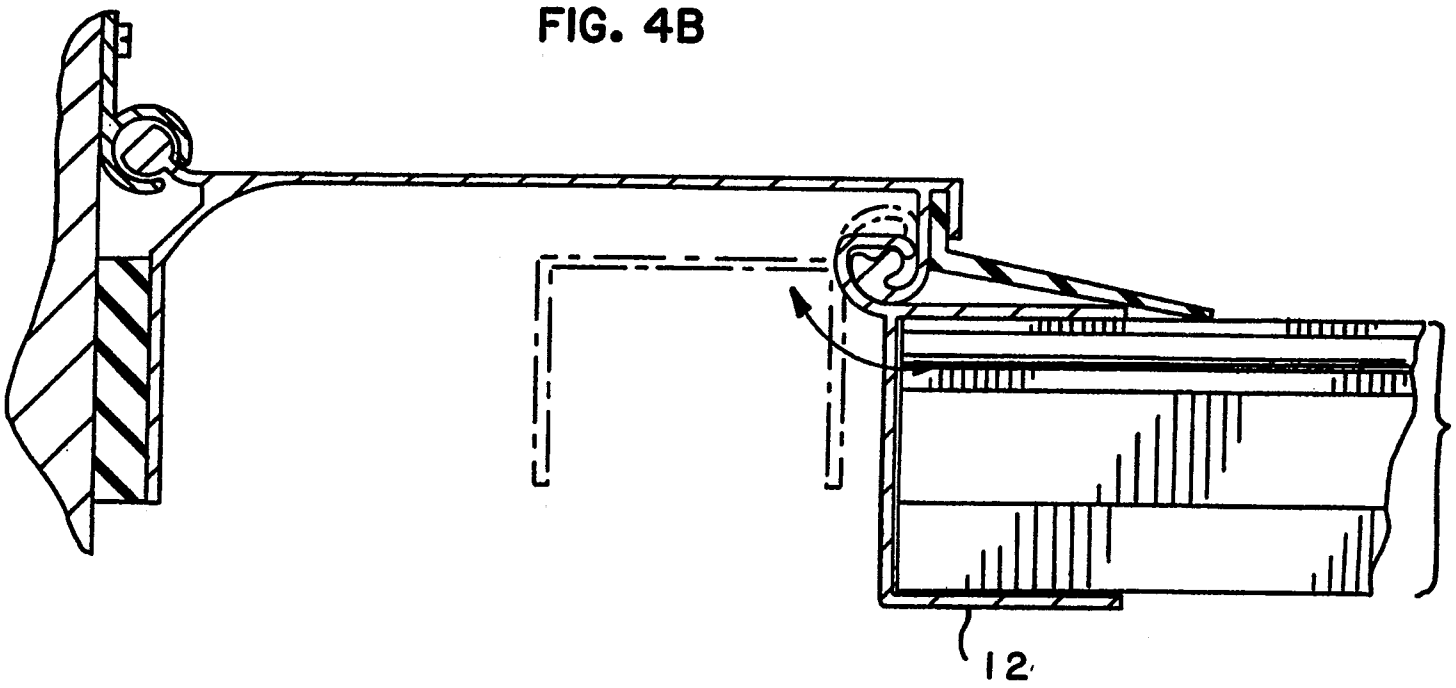
FIG. 4B is a side section view of the roof panel and adapter rail assembly of FIG. 4A, the roof panels having been pivoted upwards about the adapter rail to a nearly horizontal position.
Figure 5A:
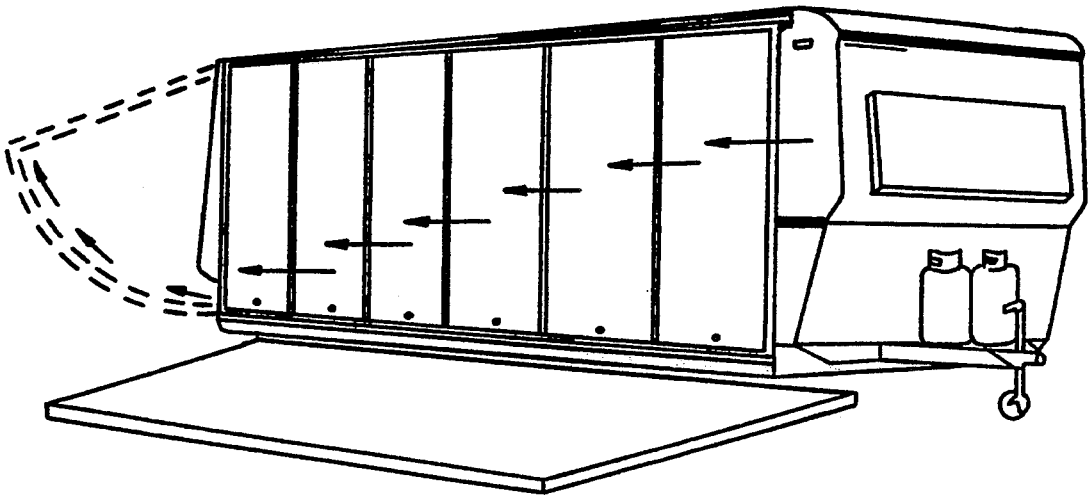
FIG. 5A is a perspective view of the trailer of FIG. 1 complete with the roof panel and adapter rail assembly of FIG. 4A, the roof panels ready to be pivoted upwards along the indicated dotted lines to a position consistent with FIG. 4B.
Figure 5B:
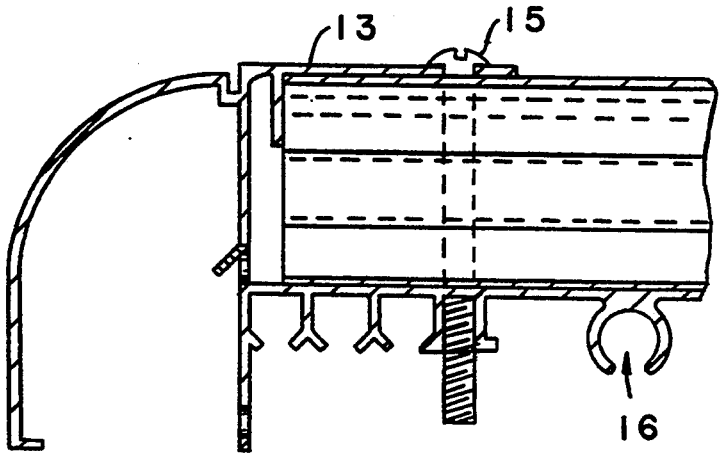
FIG. 5B is a side section view of the frontal edges of the roof panels of FIG. 3A, depicting the attachment of a front extrusion similar to the extrusion of FIG. 3A.
Figure 6:
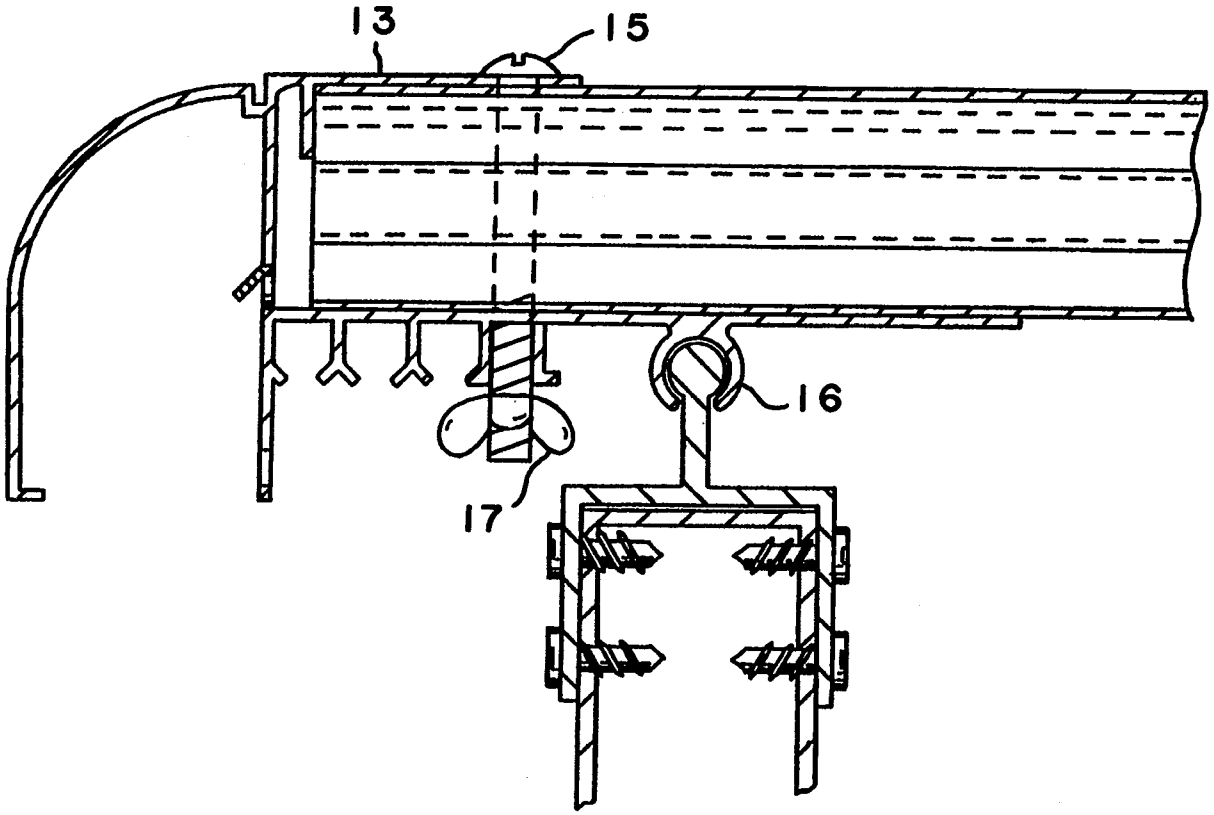
FIG. 6 is a side section view of the panel and front extrusion assembly of FIG. 5B, further illustrating the connection of the upper portion of a pole support member to the front extrusion member.

With respect to FIG. 4B, the roof panels 4, 5, 6 have been pivoted in an upward and outward direction, and the roof assembly now sits in a nearly horizontal position. The curved portion of the flange extending from each of the hanger members 12 keeps the rear end of the roof assembly stable by hooking the top surface of the turned ledge 2C of the adapter rail 3. The vinyl flashing 2B connected in the slot of the adapter rail 3 has flexed itself against the top portions of the roof panels 4, 5, 6 so as to prevent water leakage in the rear portion of the roof assembly. The roof assembly, or series of interlocked panels 4, 5, 6, must slope downwards from rear end to front end to some degree. This is so that water accumulation on the top of the roof assembly, as well as in the water troughs 11 of the female interlocking members 9, may gravity discharge off the front end of the awning. FIG. 5A illustrates the interlocked roof panels 4, 5, 6 as they form the continuous roof assembly, ready to be pivoted to a nearly horizontal position.

Figure 8A:
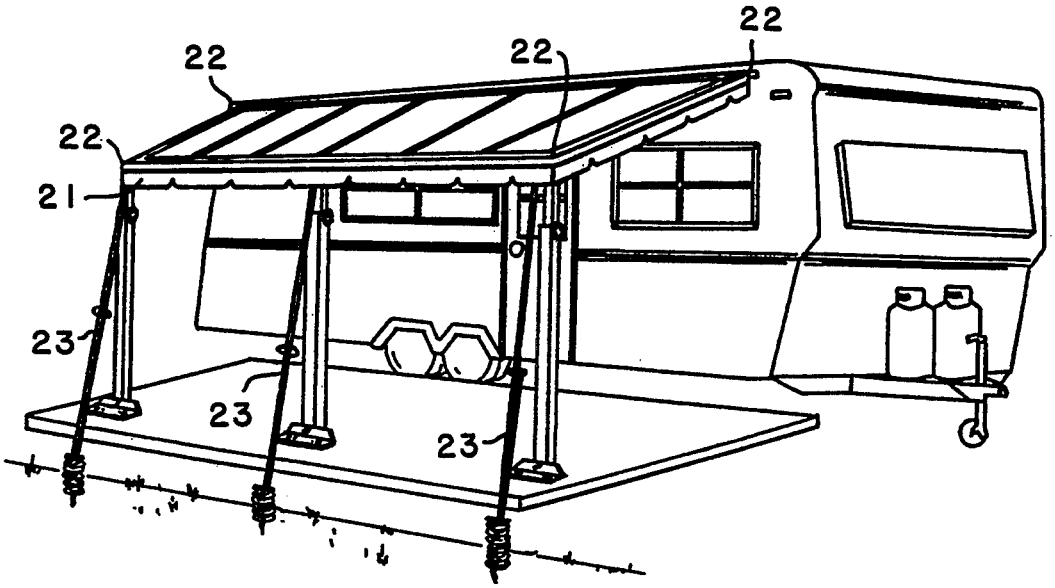
FIG. 8A is a perspective view of the recreational trailer of FIG. 1 and a completely erected awning assembly, illustrating all final connections.
Figure 8B:
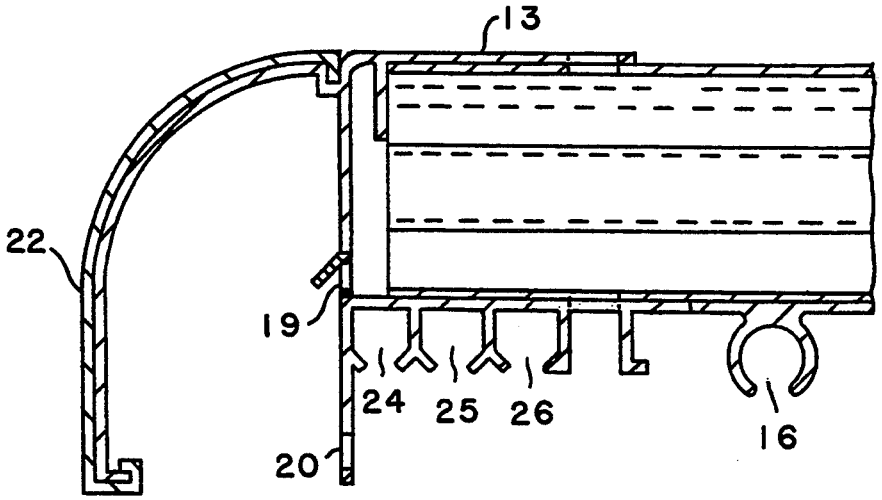
FIG. 8B is a side section view of the roof panel and front extrusion assembly of FIG. 5B, taken near the corner of the roof, and showing in detail the useful features of the front extrusion member.

Before the interlocked roof panels 4, 5, 6 are pivoted upwardly and outwardly, two frontal extrusion members 13 are attached to the front ends of the panels 4, 5, 6 by means of bolts 15 and wing nuts 17. The frontal extrusion members 13 are seen clearly in FIGS. 5B and 6, and more particularly, in FIG. 8B. The frontal extrusion members 13 are extremely similar to the side extrusion members 7 in overall geometry. The three adjacent slots 24, 25, 26 on the lower flat surfaces of the frontal extrusion members 13 are for holding a canvas valence 21 (see FIG. 8A), a screen enclosure weather panel (not shown), and a number of individual screen panels (not shown), thereby serving the same function as the three adjacent slots 24, 25, 26 found on the side extrusion members 7. The frontal extrusion members 13 also have adjustable trim 22 attached for making sealed connections at walls and corners (see FIG. 8A). The adjustable trim 22 provided on both the frontal and side extrusion members 13, 7 allow for sealed connections between the two frontal extrusion members 13, at the two corners where the frontal and side extrusion members 13, 7 join, and also at the two wall connections where the side extrusion members 7 meet the trailer 1. These connection points are depicted in FIG. 8A by reference to the adjustable trim 22.

A number of design features make the frontal extrusion members 13 distinctive from the side extrusion members 7. First, each frontal extrusion member 13 has an opening extending from its top portion to its lower portion through which a bolt 15 may pass. Each frontal extrusion member 13 has a number of apertures 19 in its middle portion through which water contained in the water troughs 11 of the female interlocking members 9 may gravity discharge. The frontal extrusion members 13 have a number of openings 20 in their lowermost portions which are adapted to receive ground tie-down straps 23 for better securing of the roof assembly. Also, spaced roughly four feet apart, the frontal extrusion members 13 have a number of curved slots 16 for receiving the cylindrical tips 18A of a number of pole supports 18.

The pole support 18 and curved slot 16 connection allows for easy set-up of the roof assembly. Take the roof panels 4, 5, 6 to have been suspended on the adapter rail 3, to have been interlocked together, and to have had attached to their front edges the two frontal extrusion members 13. When this roof assembly hangs in a vertical orientation, as in FIG. 5A, two pole supports 18 are slidingly connected to the curved slots 16 provided in the frontal extrusion members 13. These two pole supports 18 initially rest in a horizontal orientation underneath the trailer 1. The two curved slots 16 chosen are preferably towards the left and right extremities of the roof assembly. When the roof assembly is pivoted upward, the two pole supports 18 swing freely about the curved slots 16 in which they rest, and pivot to a vertical position. In this respect, the two pole supports 18 alone temporarily bear the weight of the front portion of the roof assembly. More pole supports 18 may then be attached and adjusted to the frontal extrusion members 13 so as to evenly distribute the weight of the awning roof.

Figure 7:
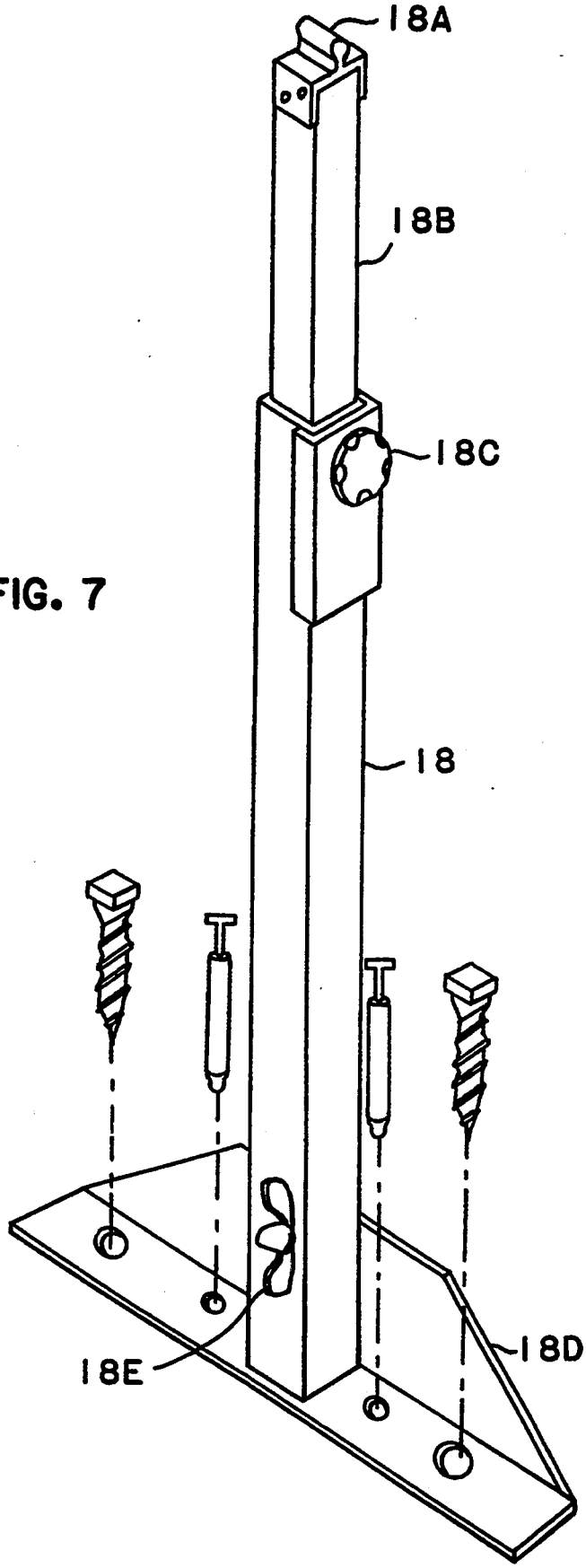
FIG. 7 is a perspective view of an adjustable height pole support member, partially shown in cross section in FIG. 6.

The pole supports 18 are seen in detail in FIG. 7. Each pole support 18 has a lower base portion 18D and an inner support member 18B which slides in a larger member. The inner support member 18B has a cylindrical tip 18A rigidly attached to its upper portion. This is the cylindrical tip 18A which mates in one of the curved slots 16 provided on the frontal extrusion members 13. The inner support member 18B may be adjusted in height by means of a knob 18C which controls an internal assembly (not shown). The inner support member 18B may be locked into position by means of a locking mechanism 18E. By cooperatively manipulating the adjusting knobs 18C and locking mechanisms 18E on the pole supports 18, the front elevation of the roof assembly may be easily adjusted. In the event that the awning will be erected for an extended period of time, apertures are provided on the lower base portion 18D to receive masonry nails (for securing the awning assembly to concrete) and screws (for securing the awning assembly to wood).

A completely erected awning is illustrated in FIG. 8A. A canvas valance 21 has been inserted into the first slot 24 provided on the frontal and side extrusion members 13, 7, and wrapped around the outer periphery of the roof assembly. When anchoring the awning to the ground, the hole 20 receives a strap with a clip which is to be connected in the hole 20 in (FIG. 8A and FIG. 8B) of the front extrusion (13) and to the handle of a spiral ground anchor.

Figure 9:
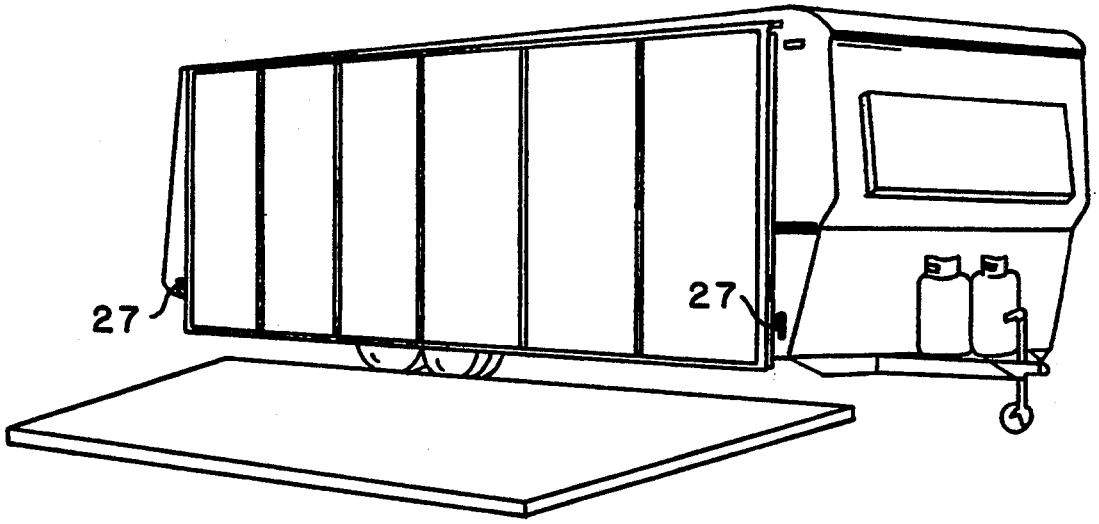
FIG. 9 is a perspective view of the trailer of FIG. 1 with an awning assembly in the fold-down and store position.

Referring to FIG. 9, the roof assembly has been folded-down to a vertical orientation. The awning is cushioned against the side of the trailer 1 with a number of rubber bumpers (not shown). The roof assembly may be locked in this position by means of two lock-down strap connectors 27.

It should be clear that the invention is not limited to the previous descriptions and drawings, which merely illustrate the preferred embodiment. Slight departures may be made within the present scope of the invention. Therefore, the invention is meant to embrace any and all equivalent apparatus, as well as all design alterations, which are described in the appended claims.

What is claimed is:

1. A portable two-way awning for trailer vehicles and the like, comprising:

an adapter rail means, said adapter rail means slidingly engageable with an awning attachment rail attached to a trailer, said adapter rail means having an upwardly turned curved ledge extending therefrom;

a left end roof panel;

a right end roof panel;

one or more intermediate roof panels;

hanger means joined to said left end, right end, and intermediate roof panels, said hanger means having a flange extending therefrom beginning in a flat portion and ending in a curved portion, the external curvature of said curved portion of said flange corresponding to the internal curvature of said turned curved ledge when said hanger means suspends said left end, right end, and intermediate roof panels from said turned curved ledge in an essentially vertical position, said flange slidingly engageable with said upwardly turned curved ledge of said adapter rail means, said flange only allowing said left end, right end, and intermediate roof panels to move in an outwardly and upwardly pivoting motion once said hanger means is slidingly attached to said upwardly turned curved ledge of said adapter rail means;

a number of male interlocking members, one of said male interlocking members bonded to one side of each of said intermediate roof panels, one of said male interlocking members bonded to one side of either said right end roof panel or said left end roof panel;

a number of female interlocking members, one of said female interlocking members bonded to one side of each of said intermediate roof panels, one of said female interlocking members bonded to one side of either said right end roof panel or said left end roof panel, said male and female interlocking members mating together to join said left end, right end, and intermediate roof panels into a rigid roof assembly;

a number of side extrusion members, at least one of said side extrusion members bonded to the outer left side of said left end roof panel, at least one of said side extrusion members bonded to the outer right side of said right end roof panel;

a number of frontal extrusion members, said frontal extrusion members attachable to the front sides of said left end, right end, and intermediate roof panels; and a number of pole supports, said pole supports connected to said frontal extrusion members and supporting a portion of the weight of said rigid roof assembly, said pole supports adjustable in height.

2. A portable two-way awning for trailer vehicles and the like as recited in claim 1, whereby said adapter rails means has a flat flange extending therefrom, wherein said flat flange has a flexible member made from rubber attached thereto, and whereby said flexible member is compressed between said flat flange and the wall of said trailer when said adapter rail means is attached to said trailer.

3. A portable two-way awning for trailer vehicles and the like as recited in claim 1, wherein said adapter rail means has a flashing made from vinyl attached to a slot, and whereby the lower portion of said flashing pivots with said rigid roof assembly.

4. A portable two-way awning for trailer vehicles and the like as recited in claim 1, whereby each of said female interlocking members has a vinyl bubble seal disposed on its upper portion and a water trough defined in its lower portion, wherein said male and female interlocking members join together without tools or caulking, and whereby any water that passes said vinyl bubble seal when said male and female interlocking members are joined together becomes entrained in said water trough and emerges at the front of said rigid roof assembly.

5. A portable two-way awning for trailer vehicles and the like as recited in claim 1, wherein both said side extrusion members and said frontal extrusion members have a plurality of adjacent slots defined in their lower portions, and whereby both said side extrusion members and said frontal extrusion members have adjustable trim means attached at their outer extremities for a sealed connection at corners or at walls.

6. A portable two-way awning for trailer vehicles and the like as recited in claim 1, wherein said frontal extrusion members have a number of curved slots in their lower portions to accept said pole supports, whereby said frontal extrusion members have a number of holes stemming from their upper portions to their lower portions to receive fastening means for attachment to said rigid roof assembly, wherein said frontal extrusion members have apertures to permit water drainage from said rigid roof assembly, and whereby said frontal extrusion members have openings for receiving ground tie-down straps to further secure and stabilize said rigid roof assembly.

7. A portable two-way awning for trailer vehicles and the like as recited in claim 1, wherein said rigid roof assembly may be pivoted to a nearly horizontal position, and whereby said rigid roof assembly may be folded down to and secured in a vertical position by means of a number of locking mechanisms.

8. A portable two-way awning for trailer vehicles and the like as recited in claim 5, wherein a canvas valence is suspended in one of said adjacent slots provided in said side and frontal extrusion members, and whereby said canvas valence extends around the outer periphery of said rigid roof assembly.

9. A portable two-way awning for trailer vehicles and the like as recited in claim 1, wherein each of said pole supports has a lower base member connected to a vertical telescoping support member having a protrusion at it uppermost point, whereby said protrusion begins in a flat neck section and ends in an enlarged cylindrical portion, wherein height adjustment means is provided on each of said vertical telescoping support members, whereby locking means is provided on each of said vertical telescoping support members, and wherein a number of apertures are provided in the lowermost surface of each of said lower base members for receiving nails, screws, or other fastening members.

10. A portable two-way awning for trailer vehicles and the like as recited in claim 1, whereby said side and frontal extrusion members join together by said adjustable trim means, wherein said adjustable trim means provides a sealed connection between said side extrusion members and the side of said trailer, and whereby said side and frontal extrusion members join together to form a continuous border around the outer perimeter of said rigid roof assembly.

11. A portable two-way awning for trailer vehicles and the like as recited in claim 1, whereby said left end, right end, and intermediate roof panels are made from two sheets of aluminum surrounding a polystyrene core.

12. A portable two-way awning for trailer vehicles and the like as recited in claim 1, whereby said adapter rail means, said male and female interlocking members, said hanger means, said side and frontal extrusion members, and said pole supports are made from a hard metal such as aluminum.

13. A portable two-way awning for trailer vehicles and the like, comprising;

adapter rail means slidingly attachable to and detachable from a standard awning attachment rail mounted to a trailer, said adapter rail means having a supporting member;

a plurality of roof panels;

hanger means joined to said roof panels, said hanger means suspending said roof panels from said adapter rail means, said hanger means having connecting means engageable with said supporting member of said adapter rail means, said hanger means allowing said roof panels to outwardly pivot about said supporting member through ninety degrees of arc;

a multiplicity of interlocking members disposed between said roof panels for joining said roof panels together to form a continuous roof assembly, and having an equal number of positive and negative slot members joined to the mating sides of said roof panels wherein each of said negative slot members has a bubble seal disposed at its upper portion and a water trough at its lower portion;

an outer skirt surrounding the left, front, and right sides of said continuous roof assembly, said outer skirt comprising a number of rigid extrusion embers joined to the outer periphery of said continuous roof assembly; and a number of pole supports readily attachable to said continuous roof assembly.

14. A portable two-way awning for trailer vehicles and the like as recited in claim 13, wherein said adapter rail means has, at one end, a flexible member attached to a flat flange, and at the other end, both a flexible flap held in a slot and an upwardly curved ledge constituting said supporting member.

15. A portable two-way awning for trailer vehicles and the like as recited in claim 13, whereby said connecting means slidingly engages with said supporting member, wherein the outer curvature of said connecting means coincides with the inner curvature of said supporting member when said roof panels hang from said adapter rail means in a vertical orientation, and whereby the attachment of said connecting means to said supporting member precludes any motion of said continuous roof assembly except for an outward pivoting movement.

16. A portable two-way awning for trailer vehicles and the like as recited in claim 13, whereby said rigid extrusion members have a number of adjacent slots provided in their lower portions, wherein said rigid extrusion members on the front sides of said continuous roof assembly are attached thereto by means of bolts, whereby said rigid extrusion members on the front sides of said continuous roof assembly have apertures for water drainage from said continuous roof assembly, wherein said rigid extrusion members on the front sides of said continuous roof assembly have a number of curved slots to accept pole supports, whereby said rigid extrusion members on the front sides of said continuous roof assembly have openings in their lower portions to receive tie-down straps, and wherein said rigid extrusion members have adjustable trim means disposed at their extremities for forming sealed and continuous connections.

17. A portable two-way awning for trailer vehicles and the like as recited in claim 13, wherein said pole supports are adjustable in height, whereby said pole supports comprise a number of vertical telescoping members joined to apertured plates, and wherein each of said vertical telescoping members has a height adjustment knob and locking mechanism disposed along its length.

18. A portable two-way awning for trailer vehicles and the like as recited in claim 13, wherein said continuous roof assembly may be pivoted to a nearly horizontal position, and whereby said continuous roof assembly may be folded down to and secured in a vertical position by means of a number of locking mechanisms.

19. A portable two-way awning for trailer vehicles and the like as recited in claim 16, wherein a canvas valence is suspended in one of said adjacent slots provided in said rigid extrusion members, and whereby said canvas valence extends around the outer periphery of said continuous roof assembly.

20. A portable two-way awning for trailer vehicles and the like as recited in claim 13, whereby said roof panels are made from two sheets of aluminum surrounding a polystyrene core.

21. A portable two-way awning for trailer vehicles and the like as recited in claim 13, whereby said adapter rail means, said interlocking members, said hanger means, said rigid extrusion members, and said pole supports are made from a hard metal such as aluminum.

* * * * *